US006068562A

United States Patent [19]

Hedges

[11] Patent Number: 6,068,562

[45] Date of Patent: May 30, 2000

[54] LONG-SHAFTED GOLF CLUB AND METHOD

[75] Inventor: James S. Hedges, Springfield, Mo.

[73] Assignee: Hedges Investments, Ltd., Southlake, Tex.

[21] Appl. No.: 09/081,371

[22] Filed: May 19, 1998

Related U.S. Application Data

[60] Provisional application No. 60/050,347, Jun. 20, 1997.

[51] Int. Cl.[7] ..... A63B 57/00

[52] U.S. Cl. ..... 473/409; 473/294

[58] Field of Search ..... 473/293, 294, 473/298, 299, 300, 313, 314, 409

[56] References Cited

U.S. PATENT DOCUMENTS

| | | | |
|---|---|---|---|
| 3,574,349 | 4/1971 | Kropp | 473/294 |
| 3,679,207 | 7/1972 | Florian | 473/294 |
| 3,945,646 | 3/1976 | Hammond . | |
| 4,163,554 | 8/1979 | Bernhardt | 473/294 |
| 4,566,696 | 1/1986 | Horgen . | |
| 4,605,228 | 8/1986 | Guendling, Jr. . | |
| 4,878,673 | 11/1989 | Pollard . | |
| 5,013,045 | 5/1991 | Elmore . | |
| 5,024,438 | 6/1991 | Candow . | |
| 5,269,528 | 12/1993 | McCardle, Jr. . | |
| 5,374,062 | 12/1994 | Kochevar . | |
| 5,478,073 | 12/1995 | Hackman . | |
| 5,520,392 | 5/1996 | Foresi et al. . | |
| 5,616,089 | 4/1997 | Miller . | |
| 5,785,608 | 7/1998 | Collins | 473/294 |
| 5,830,082 | 11/1998 | White | 473/294 |
| 5,855,524 | 1/1999 | Jenkins | 473/294 |

*Primary Examiner*—Steven Wong
*Attorney, Agent, or Firm*—Jonathan A. Bay

[57] ABSTRACT

Long-shafted golf clubs are disclosed to give flight to or loft a ball toward a target along a target line. A method of use includes the following aspects. A club is selected which when stood upright has a shaft that reaches about the chest of the player who will use it. The player addresses the ball by a stance that faces the target line from one side, and is generally upright with knees and waist substantially straight except that the head is down as needed to see the ball. The player holds the shaft at an upper-grip location with an upper hand by an underhand grip, having thumb up, and at about chest height. The player holds the shaft at a lower-grip portion with the other or lower hand by an underhand grip, having the thumb down, and at about hip height. Following that the player winds up in a half-swing, at the top of which the arm of the lower hand is outstretched as needed to support the shaft and the upper hand is stationed in front of the chest to define a relatively fixed center of swing for the club. Then ball is stroked by virtue of a pendulum-style downswing, the shaft being motivated by the lower hand and arm thereof while the upper hand remains substantially stationary. During execution of the downswing, or at least until the ball is contacted, the downswing is done substantially without flexing the knees or twisting the waist or shoulders.

12 Claims, 5 Drawing Sheets

LONG-SHAFTED GOLF CLUB AND METHOD

CROSS-REFERENCE TO PROVISIONAL APPLICATION(S)

This application claims the benefit of U.S. Provisional Application Ser. No. 60/050,347, filed Jun. 20, 1997.

BACKGROUND AND SUMMARY OF THE INVENTION

The invention generally relates to golf clubs and more particularly to long-shafted golf clubs other than putters. This includes drivers, irons, chippers and wedges and the like. The use of these clubs is distinguished from putters in that, rather than rolling the golf ball, they are called on to give flight to or loft the ball. The club shafts are considered "long-shafted" because when stood upright the shafts are as tall as a player's chest. In use, a player swinging a long-shafted club in accordance with the invention, can do so in nearly an upright stance. This differs from use of conventional clubs which require a bent over, stooped or crouched stance.

Giving golf clubs relatively long shafts is practically unknown except in putters. However putters are used far differently from all other clubs. The use of putters is conventionally limited to rolling or lagging the ball by a mild stroke on a green where the grass will allow a true roll. It has long been evident that there is nothing incompatible in how a putter is used (vis-a-vis a putt stroke) regardless whether the shaft is long or not.

Putters aside, there has been little or no experience with long shafts for other kinds of clubs. Evidently, conventional wisdom holds that the crouch is necessary to properly address or see the ball or else strike it sufficiently hard for long strokes, and so on.

The inventor hereof is well-aware of the typical adverse reaction that his long-shafted clubs provoke from conventionally-minded golf players:—the general reaction has been that, to come out of a crouch and stand upright to swing a club will sacrifice much distance in every shot. For many players, the sacrifice of distance is simply too much of a drawback no matter what else the long-shafted clubs may have to offer. Such sentiments are valid from highly competitive players. For many other players, however, their enjoyment of golf is not strictly measured by their score and their long game.

It is an object of the invention to provide golf clubs chosen from a group consisting essentially of drivers, irons chippers and wedges, with long shafts.

The long shafts allow a player to address the ball in a generally upright stance. They spare the player from having to bend over, or stoop or crouch. It has been discovered that the player's eyes are directly above the butt end of the long shaft. Thus his or her focus is naturally drawn down the length of the shaft to the ball. As a result, the player naturally and easily assumes a proper head position in addressing the ball, as well as maintains proper head movement during the swing.

It is preferred that these long-shafted clubs are held with hands spread far apart as follows. One hand gets the lower grip position, which is about hip high and has the thumb down and the palm facing the direction of the target. The other hand gets the upper grip position, which is about chest high and has the thumb up and the palm facing the player. It has been discovered that beginners or novice users of these long-shafted clubs easily and naturally adapt to holding the clubs this way.

It has also been discovered that the inventive clubs simplify the alignment of the arms as the player swings the club. It has further been discovered that the inventive clubs simplify the way that the player shifts weight during a swing. The inventive clubs eliminate the need for cleated golf shoes because the player swings relatively flat-footed and so can do without the traction of cleats.

In view of the foregoing, the inventive clubs provide comparable loft to the ball as conventional clubs do. It is easier to master straight shots and avoid hooks or slices. The inventive long-shafted clubs are swung pretty much like a pendulum and hence impart little else but a forward spin on the ball, whereas with conventional clubs there is much greater risk that significant sidespin will carry the ball to hook or slice.

These and other discoveries and objects in accordance with the invention are provided by long-shafted golf clubs such as drivers, irons, chippers and wedges. The long-shafted golf clubs simplify many of the factors in making good contact with the ball which complicate the use of conventional golf clubs. These factors include without limitation (i) head positioning and movement, (ii) hand grip, (iii) arm alignment, and/or (iv) the timing and proportioning of shifting weight during a swing.

These simplifications are attractive to beginners or novices. Alternatively, they are attractive to the elderly or the stiff who experience discomfort with bent over, or stooped or crouched stances.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figures 1, 2, 3, 4:
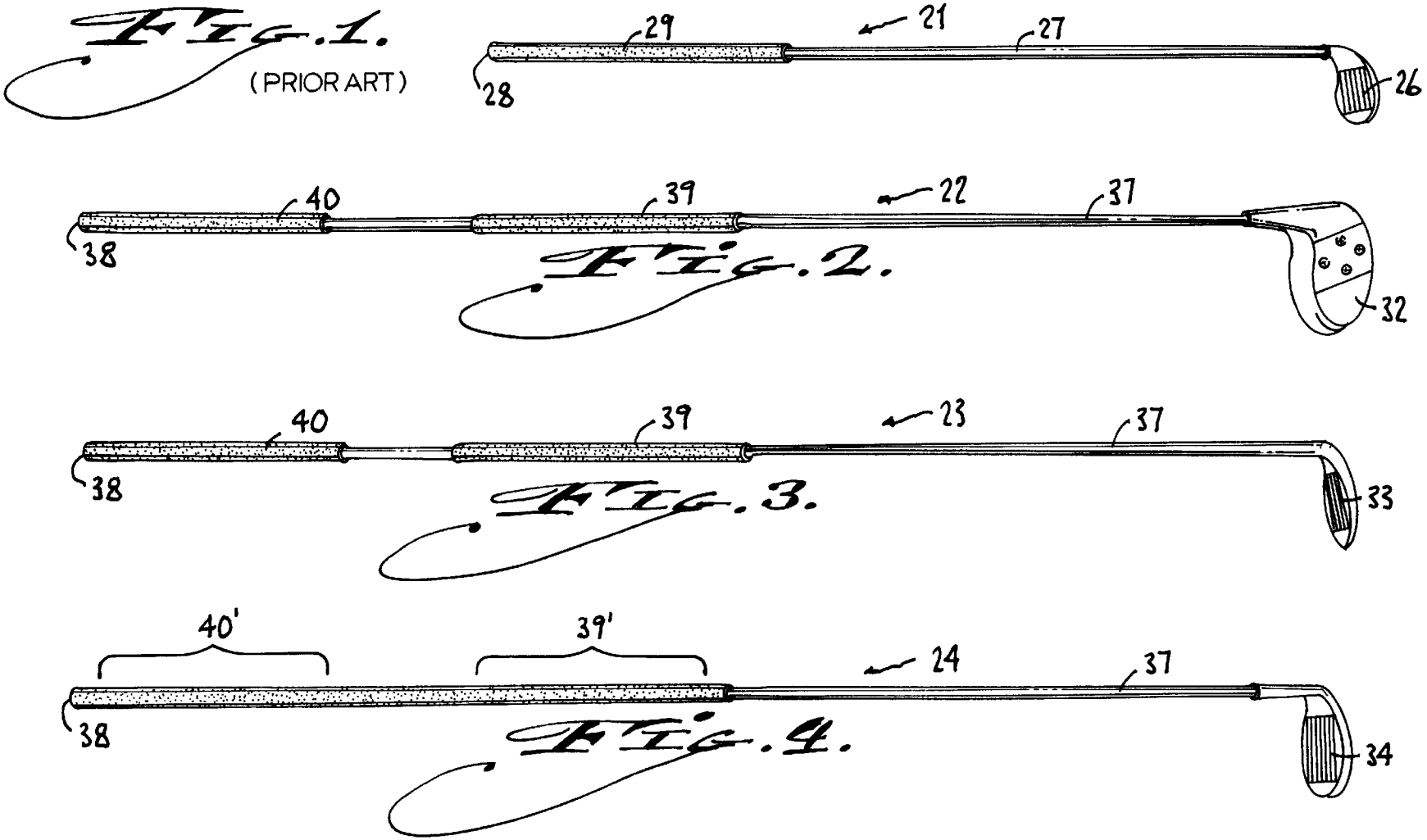
FIG. 1. (PRIOR ART)
FIG. 1 is a perspective view of a golf club representative of the prior art.
FIG. 2 is a perspective view of a long-shafted golf club in accordance with the invention, which more particularly is a driver.
FIG. 3 is a perspective view of an alternate embodiment thereof, which more particularly is a chipper.
FIG. 4 is a perspective view of another embodiment thereof, which more particularly is an iron.

FIGS. 2 through 4 show assorted long-shafted golf clubs 22–24 in accordance with the invention, including drivers 22, irons 23 (eg., inclusive of wedges too), and chippers 24 and the like. For scale, FIG. 1 is included to show a conventional golf club 21 having a representative shaft-length of the prior art.

Figure 6:
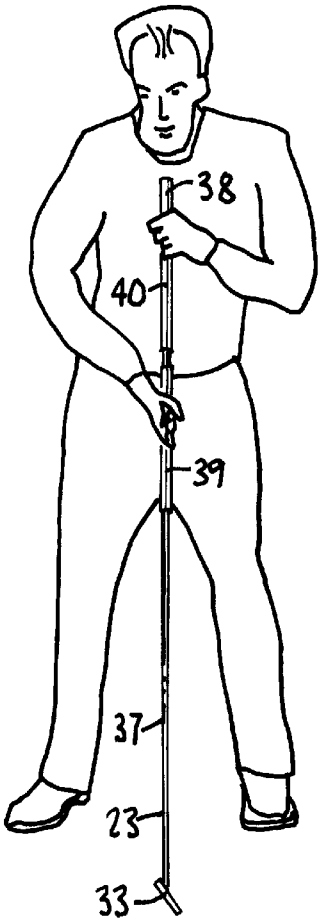
FIG. 6 is a front perspective view of a player addressing a ball with a long-shafted golf club in accordance with the invention.

The FIG. 1 golf club 21 has a clubhead 26 affixed at one end of the shaft 27, which terminates in a butt end 28 covered by a single grip sleeve 29. If this club 21 is stood upright next to a player (this is not shown) with the clubhead 26 resting on the ground, the butt end 28 reaches about to the waist of the player. The FIGS. 2 through 4 golf clubs 22–24 each have a clubhead 32–34 affixed at one end of a relatively longer shaft 37. When these clubs 22–24 are stood upright next to a player, and clubhead 32, 33, or 34 resting on the ground, the butt end 38 reaches about to the chest of the player (see, eg. FIG. 6 et seq.). In FIGS. 2 and 3, the shaft 37 of clubs 22 and/or 23 carries two grip sleeves 39–40, one of which is a lower sleeve 39 which corresponds in distance from the clubhead 32, 33, or 34, in about equal measure as the single sleeve 29 on the prior art club 21. The other or upper sleeve 40 is spaced away from the lower sleeve 39 and covers portions of the shaft 37 at the butt end 38.

Alternatively, the FIG. 4 iron 24 has a single elongated grip sleeve on which are defined virtual upper and lower grip portions 40' and 39'.

Figure 5:
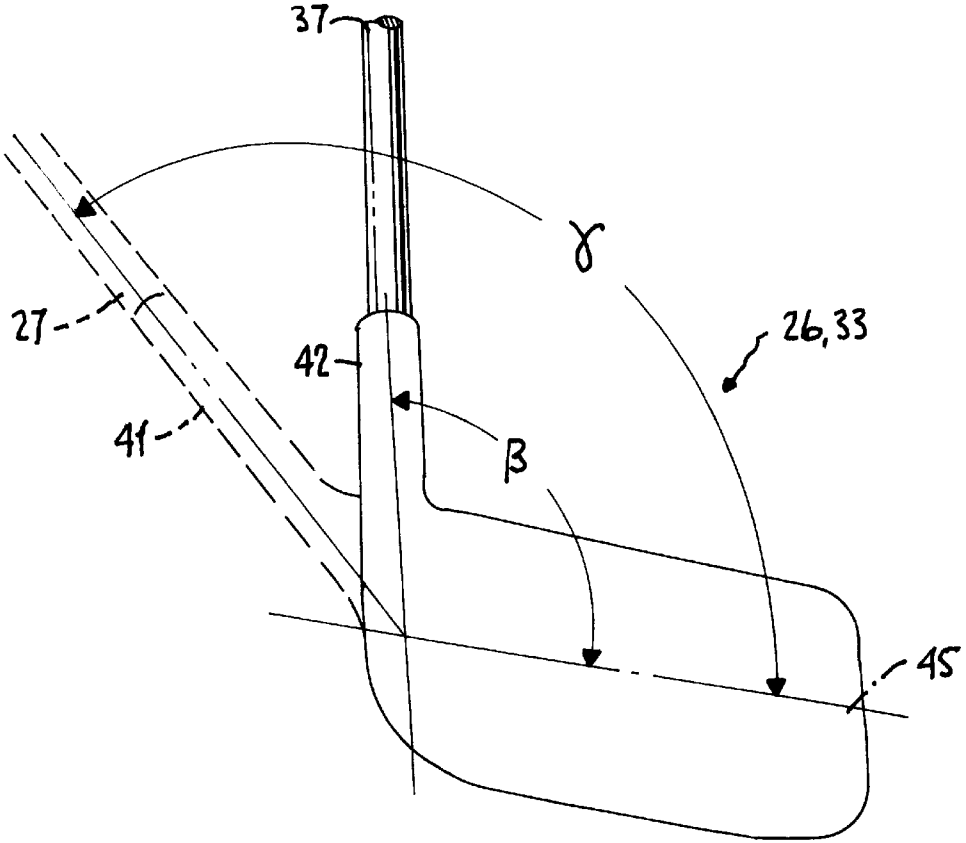
FIG. 5 is an enlarged detail view comparing the angular difference(s) between the hosel for the clubheads of FIGS. 2–4 (shown in solid lines) and the hosel of the FIG. 1 prior art clubhead (shown in dashed lines)

FIG. 5 shows the angular difference(s) between the hosel 42 for the clubheads (eg., 33) of FIGS. 2–4 (shown in solid lines) and the hosel 41 of the FIG. 1 prior art clubhead 26 (shown in dashed lines). The horizontal datum is indicated by reference numeral 45. It is parallel to the bottom of the clubhead 26/33 and would be parallel to the ground when the clubhead 26/33 is rested flat on the ground. The prior art hosel 41 extends at angle "$\alpha$" relative to datum, which in gross terms corresponds to about 135° or so. The hosel 42 for the inventive clubhead 33 extends at angle "$\beta$," which more closely corresponds to a value of about 100° or preferably greater if not 100°. Put differently. when a player addresses a ball with one of the inventive clubs 22–24, preferably he or she inclines the shank toward him or herself about 10° from vertical, as will be more particularly described below.

FIGS. 6 through 10 comprise a set of views showing a method of using the long-shafted clubs 22–24 in accordance with the invention.

By way of background, the following comprises a description of how the FIG. 1 prior art club 21 is conventionally used (none of which is illustrated). That is, a player grasps the lone grip-sleeve 29 with both hands. For right-handed players, the left hand (ie. the non-dominant hand) grasps the grip sleeve 29 just below the butt end 28 with an overhand grip (ie., thumb down). The term "overhand grip" means that, if the player sought to curl the club like a barbell (ie., extending horizontally across the front of his chest), his handhold would be overhand. "Underhand grip" means the reverse. The right (ie., dominant) hand grasps the grip sleeve 29 just below the left hand with an underhand grip (ie., thumb also down). A golf ball, for stroking to a target along a target line, is addressed in a stance facing the target line. Feet, knees, hips, chest, shoulders, and even the eyes are all parallel to the side of the target line. Feet are shoulder width apart. The ball is positioned off the left heel for most shots. The player bends forwardly at the waist to address the ball in a crouch. The backswing is executed by having the shoulders rotate about the spine. The backswing is at least started with the club 21, shoulders, and arms rigid as a unit (eg., sometimes referred to as the Triangle). The left knee bends toward the right foot. The player shifts weight to balance it over the right foot, in a position to push off back through the ball. The hips turn minimally. At the top of a "full" backswing, the left shoulder is over the right foot, and hands are reached out high above and behind the head. Eyes remain on the ball, and the swing center is preferably kept centered, although the head must release to the right a little to allow the "full" wind up. The goal for a "full" backswing is to get wound up with as much weight possible behind the ball so that there is a tremendous amount to potential energy to swing through the ball toward the target.

In distinction, FIGS. 6 through 10 show the use of the inventive clubs (e.g., by means of a "half-swing." In FIG. 6, a right-handed player (matters simply being a mirror opposite image for left-handers) holds the shaft 37 with his hands spread apart. The player lines up with the club in front and centered as shown, but inclined back toward himself (not discernible in the view) by about 10° from vertical. His right hand holds the lower grip 39 at about hip height with an underhand grip (ie., thumb down) and with the palm facing the direction of the target. For convenience in this description, the hand (eg. the right hand as shown in the drawings) which grasps the lower hand grip or grip portion 39 or 39' will be referred to as the "lower hand." The right arm is cocked or flexed slightly, as shown, though not too much from being straight. The left hand (ie. correspondingly referenced herein as the "upper") hand holds the upper grip 40 at about chest height with an underhand grip (ie., thumb up) and with the palm facing the player. His left elbow is flexed beyond 90° as shown. In fact the player might optionally rest the butt end 38 of the shaft 37 against his chest as he holds the lower hand-grip 39 slightly spaced forward of his waist, with his right arm cocked slightly forward. His head is nearly directly over the ball, and he has the whole extent of the shaft 37 in view while focusing on the ball.

The player addresses the ball in nearly erect or upright stance flat-footed, and facing the target line (eg., the target line would extend in the left to right direction in the view). Feet, knees, hips, chest, shoulders, and even the eyes are all parallel to the side of the target line. Feet can be shoulder-width apart or even closed in a little, as about hip-width apart or less. His weight is balanced relative to the vertical plane of symmetry containing the center of the swing. The ball is positioned off the left heel for most shots. Whereas the waist is straight and the spine upright, the head is tipped down in order to hone in on the ball down the extension of the shaft 37.

Figure 8:
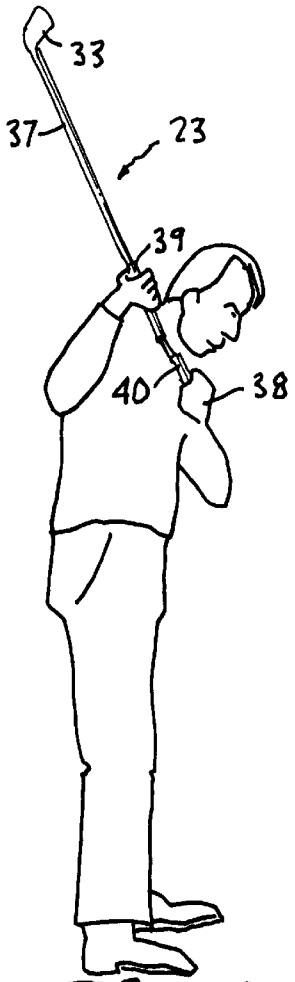
FIG. 8 is a left side view of FIG. 7.
Figure 7:
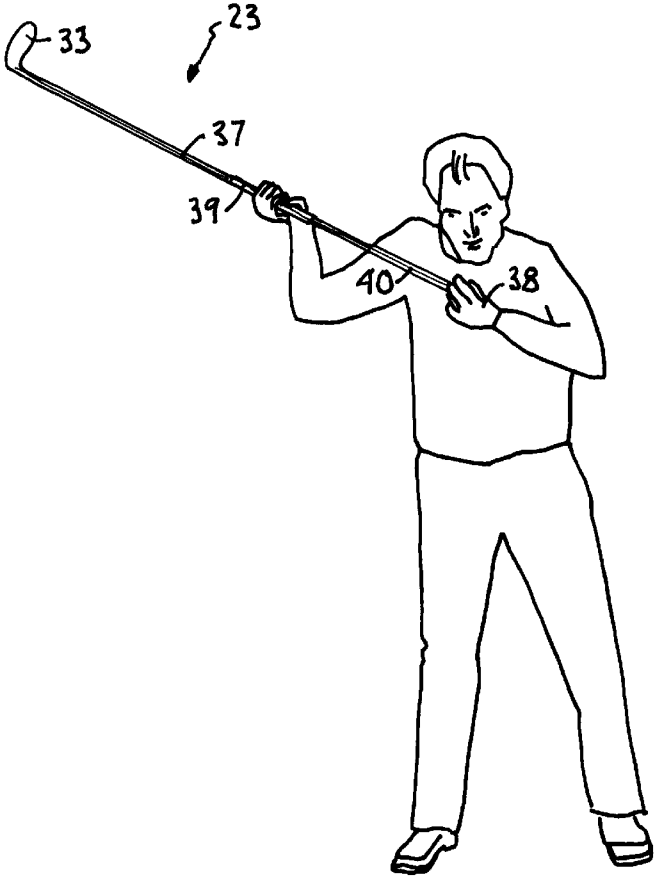
FIG. 7 is a comparable front view thereof, except showing completion of the back swing.

FIGS. 7 and 8 show the completion of the half-swing (ie., FIG. 7 is from the front and FIG. 8 from the left). The club has reached the top of the half-swing and is stopped there momentarily before start of the downswing. The player's left or upper hand still marks the center of the swing. He has executed this half-swing by rotating the club up with his right or lower hand while steadying the center of the swing with his left hand. The club is rotated up much like a pendulum about the swing center (again, which is through the left hand). The shoulders do not rotate about the spine, however the right shoulder is released up a little as the left shoulder is a little bit dropped to allow the right arm to abduct as shown. The weight remains more or less balanced across the center of the swing without much shift onto the right foot (or the left foot for that matter). However. typically there is a slight shift of weight onto the right foot caused by the changed inertial moment of the player because of his abducted right arm. The player still stands flat-footed. Preferably there is no bending at the knees or waist, nor any twisting in the hips, torso or shoulders. Overall, the body preferably maintains its parallel alignment with the target line. Which alignment is again:—the feet, knees, hips, chest, shoulders, and even the eyes should all be parallel to the side of the target line. Eyes are on the kept ball.

FIG. 8 shows where the club 23 stops at the top of the half-swing, from the side of the player. The club 23 has been rotated remaining pretty much constantly within an inclined plane containing both the club 23 (as it appears in FIG. 8) and the ball. That is, the backswing of the club 23 is carried out in a plane inclined from true vertical by between about 10° and 22° or so (in the counterclockwise direction as shown). Preferably the player downswings the club 23 in the same plane to make square contact with the ball. That way, the ball is given predominantly a forward spin with no or negligible sidespin. Experience finds that swinging any of these long-shafted clubs 22–24 this way gets a straight shot the majority of times.

Figures 9, 10:
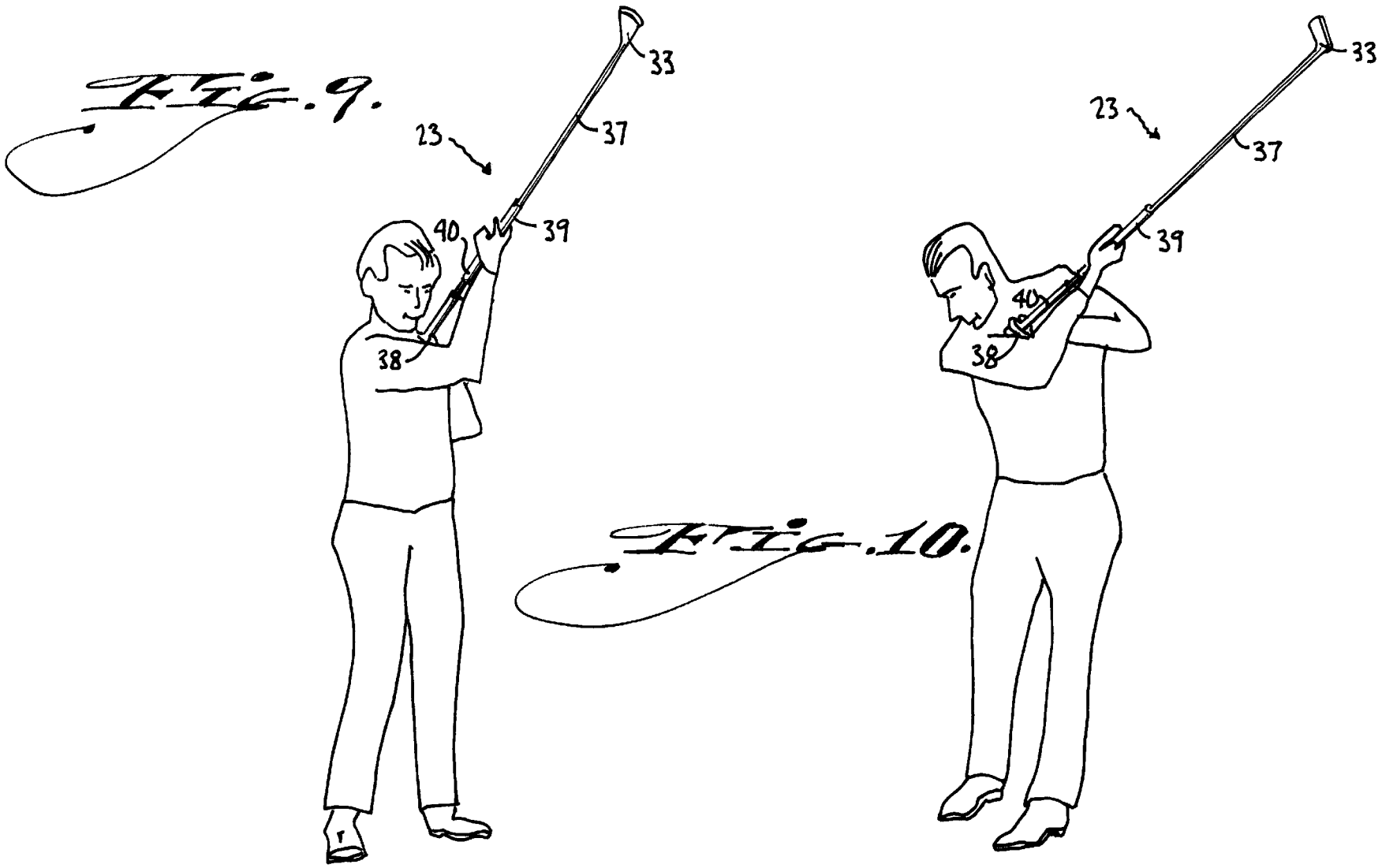
FIG. 9 is a front view comparable to FIG. 7, except showing completion of the fore swing.
FIG. 10 is a right side view of FIG. 9.

FIGS. 9 and 10 show the completion of the downswing. The club 23 is shown where it stops given a complete follow-through. The player's left hand still remains in the center of his chest. He has executed the downswing by sweeping his right hand through about half a circle while steadying the center of the swing with his left hand. That is, the player holds the center of the swing stationary to the best of his practical ability. The club 23 has likewise swept through about half a circle, rotating much like a pendulum about the swing center (again, which is through the left hand).

The shoulders have rotated slightly because the thrusting of the right arm has pulled and dropped the right shoulder around a little to the front. The left shoulder has yielded accordingly to rotate a little to the rear. The right foot carries more weight now than the left, but the weight shift occurred after the ball was struck. There is no or negligible bending at the waist and only slight flexion in the right knee. Overall, the body remains substantially erect but with less than a quarter of a twist in the hips and shoulders. The eyes may follow the flight of the ball (although this is not shown).

The power for the downswing is developed by the right arm thrusting the shaft 37 down so that the clubhead 33 develops substantial velocity at the end of the long shaft 37 relative the stationary butt end 38. Substantial clubhead 33 velocity corresponds to substantial momentum which in turn corresponds to contact with the ball with a substantial impulse. It is an inventive aspect that the player need not drive off his right foot to develop power. Hence the golf clubs 22–24 largely obviate the need for wearing cleats. The player's stance is flat-footed at least through the power-developing stages of the swing, without driving off one foot or the other.

Comparison of the sequence of FIGS. 6, 7 and 10 shows that the center of the swing through about the butt end 38 of the shaft 37 is maintained in a relatively stationary position directly in front of the chest of the player. As previously mentioned, to help himself hold the center of the swing stationary, the player might have rested his left hand or the butt end 38 of the shaft 37 against his chest. His left arm remains relatively motionless throughout the swing although his left hand does relax its grip at times to allow the club to pivot about the center of the swing, pendulum-style.

FIGS. 6 through 10 show a right-handed player holding the club 23 by handholds as preferred at least in this respect, and that is, that the right hand grasps the club shaft 37 by the lower hand grip 39, with the left hand on the upper grip 40. In FIG. 6, the player is addressing the golf ball such that the target is to his left. However, experience has shown the following alternative use of the clubs 22–24.

That is, a player can address the ball as shown in FIG. 6, and alternatively switch her or his left and right hands. The right hand thus holds the upper grip 40 and the left hand has the lower grip 39 (this is not shown). Even with hands switched as described, the player still strives to hit the ball to a target on his left. Thus the player's right hand holds the center of swing stationary. The left arm backswings the club 23 (eg., for orientation refer to FIG. 6) clockwise by extending the left arm across the front of the stomach, then drives the club 33 through a counterclockwise downswing by a back-arm rotation of the left arm about the left shoulder. Whereas it is presumed that less power can be developed by switching the hands around, this last-described method achieves sufficient results for relatively short chips and the like.

Figure 12:
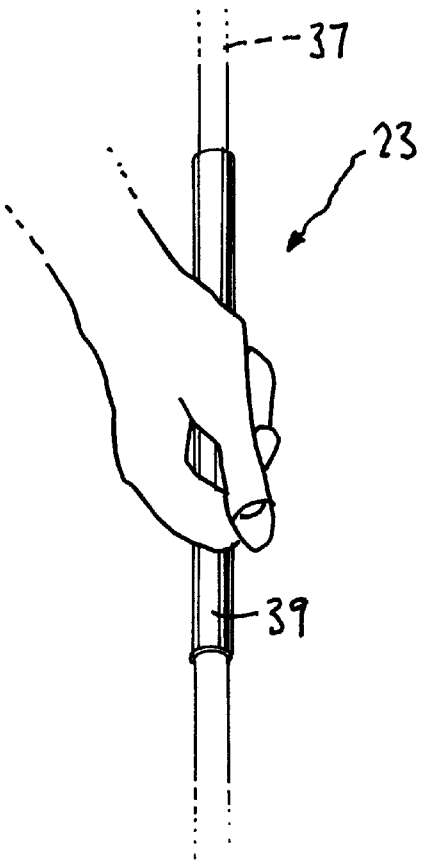
FIG. 12 shows another manner of handhold on the lower grip.
Figure 11:
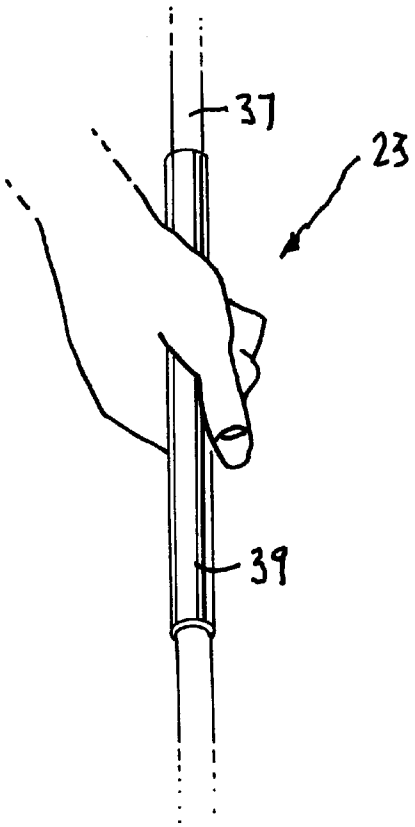
FIG. 11 shows one manner of handhold on the lower grip.

FIGS. 11 and 12 show various styles of how to hold the club 33 at the lower handhold 39 (eg., as by the lower hand). FIG. 11 shows a conventional underhand grip, in which the fingers are all curled in one direction around the shaft 37 and thumb extends around in the opposite direction. FIG. 12 shows the shaft 37 situated between the index finger and the middle finger. Other handholds are possible and comfortable but are not shown.

To turn back to FIGS. 2 through 4, the long-shafted golf clubs 22–24 in accordance with the invention encompass drivers 22, irons 23 (eg., wedges too), chippers 24 and the like:—eg., clubs other than putters. Putting is often called "a game within a game," and neither putters nor putting forms any part of the invention. The use of these clubs 22–24 is distinguished from putters in that, rather than rolling the golf ball on a suitable smooth surface like a green, these clubs 22–24 are used give light to or loft the ball. The chipper 24 optionally could be given a double-faced clubhead 34 for use by left- or right-handed players as desired in non-USGA regulation play (eg., the USGA disallows double-faced chippers for USGA-regulation play).

Indeed, all the clubs 22–24 in accordance with the invention can be made in left-handed models as equally as the right-handed models shown by the drawings. Whereas only right-handed models and right-handed use has been shown in the drawings, this was done this way merely for convenience in this description and the invention is therefore not limited to right-handed clubs or use only.

The exact length of any given club 22, 23 or 24 can be varied within limits to match the height of a given player. Taller players shall need slightly longer shafts 37 than do shorter players. Regardless of scale or proportion, each of the clubs 22–24—whether modified for a tall player or a short player—is held and used as disclosed above without meaningful difference between tall and short players.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method of swinging a long-shafted golf club to give flight to or loft a ball, comprising the steps of:

selecting a club that when stood upright has a shaft that reaches about the chest of the given player and that is provided with a clubhead that has a hosel inclined at an angle of about 100° relative to a bottom surface of the clubhead;

addressing the ball to stroke to a target along a target line by a stance that faces the target line from one side, with shoulders generally parallel to the target line such that one shoulder is nearer the target, and which stance is generally upright with knees and waist substantially straight except that the head is down as needed to see the ball;

holding the shaft at an upper grip portion with an upper hand by an underhand grip, with thumb up, at about chest height, and the palm generally facing the player, wherein the arm of the upper hand is of the shoulder nearer the target;

resting the upper hand stationary against the middle of the chest for the duration of the swing at least through contact with the ball;

holding the shaft at a lower grip portion with the lower hand by either a full or modified underhand grip, with thumb down, at about hip height;

winding up in a half-swing to bring the clubhead to a level about even with or higher than the upper hand that is stationed in the middle of the chest, at the top of which half-swing the arm of the lower hand is outstretched as needed to support the shaft while the upper hand remains stationed in front of the chest to define a relatively fixed center of swing for the club, wherein the fingers of the upper hand relax and open sufficiently to allow the club to pivot so that said fixed center is held between the thumb and index finger; and stroking the ball with a pendulum-style downswing, the shaft being motivated by the lower hand and arm thereof while the upper hand remains substantially stationary, wherein the fingers of the upper hand are allowed to re-close as the clubhead reaches the bottom of the downswing, and which step of stroking the ball is, at least until the ball is contacted, executed substantially ● flat-footed, ● weight evenly balanced on the feet, and ● without flexing the knees or twisting the waist or shoulders.

2. The method of claim 1 wherein selecting the club further comprises selecting a given club chosen from a group essentially consisting of drivers, irons, wedges, and chippers.

3. A method of swinging a long-shafted golf club to drive a ball, comprising the steps of:

selecting a club from a group consisting essentially of drivers and irons, which club when stood upright has a shaft that reaches about the chest of the given player and that is provided with a clubhead that has a hosel inclined at an angle of about 100° relative to a bottom surface of the clubhead;

addressing the ball to stroke to a target along a target line by an upright stance facing the target line with weight balanced on both feet and with shoulders generally parallel to the target line such that one shoulder is nearer the target;

holding the shaft at an upper grip portion with an upper hand at about chest height, by an underhand grip and thumb up, and the palm generally facing the player, wherein the arm of the upper hand is of the shoulder nearer the target;

resting the upper hand stationary against the middle of the chest for the duration of the swing at least through contact with the ball;

holding the shaft at a lower grip portion with the lower hand at a location spaced below the upper hand, and with thumb down and the palm facing the direction of the target;

winding up in a half-swing to bring the clubhead to a level about even with or higher than the top of the players' head, at the top of which the arm of the lower hand is outstretched as needed to support the shaft while the upper hand remains stationed in front of the chest to define a relatively fixed center of swing for the club, wherein the fingers of the upper hand relax and open sufficiently to allow the club to pivot so that said fixed center is held between the thumb and index finger; and stroking the ball with a pendulum-style downswing, the shaft being motivated by the lower hand and arm thereof while the upper hand remains substantially stationary, wherein the fingers of the upper hand are allowed to re-close as the clubhead reaches the bottom of the downswing, and which step of stroking the ball is, at least until the ball is contacted, executed substantially without moving in the knees or waist.

4. The method of claim 3 wherein the feet are generally between about shoulder-width apart and narrower.

5. The method of claim 3 wherein the step of stroking the ball is, at least until the ball is contacted, executed substantially with weight evenly balanced on the feet.

6. The method of claim 3 wherein the step of stroking the ball is, at least until the ball is contacted, executed substantially flat-footed.

7. The method of claim 1 wherein the modified underhand hand grip has the club shaft situated between the index and middle fingers.

8. The method of claim 1 wherein the step of winding up in a half-swing is further executed until the clubhead is brought to a level about even with or higher than the top of the player's head.

9. The method of claim 1 wherein the feet are generally between about shoulder-width apart and narrower.

10. The method of claim 1 wherein the winding up in the half-swing and the stroking the ball with a downswing are executed until at least contact with the ball such that the club traces through an inclined plane containing both the club and the ball that is inclined from vertical by between about 10° and 22°.

11. The method of claim 3 wherein the lower hand grips the club shaft with the club shaft situated between the index and middle fingers.

12. The method of claim 3 wherein the winding up in the half-swing and the stroking the ball with a downswing are executed until at least contact with the ball such that the club traces through an inclined plane containing both the club and the ball that is inclined from vertical by between about 10° and 22°.

* * * * *